US010711513B2

(12) United States Patent
Wang

(10) Patent No.: US 10,711,513 B2
(45) Date of Patent: Jul. 14, 2020

(54) DOOR PANEL AND A STILE THEREOF

(71) Applicant: Nan Ya Plastics Corporation, Taipei (TW)

(72) Inventor: Kuei-Yung Wang, Taipei (TW)

(73) Assignee: NAN YA PLASTICS CORPORATION (TW)

( * ) Notice: Subject to any disclaimer, the term of this patent is extended or adjusted under 35 U.S.C. 154(b) by 0 days.

(21) Appl. No.: 15/863,145

(22) Filed: Jan. 5, 2018

(65) Prior Publication Data

US 2018/0128037 A1 May 10, 2018

(51) Int. Cl.

| | |
|---|---|
| ***E06B 3/72*** | (2006.01) |
| ***E06B 3/82*** | (2006.01) |
| ***E06B 3/70*** | (2006.01) |
| *E06B 3/984* | (2006.01) |

(52) U.S. Cl.

CPC ..... *E06B 3/723* (2013.01); *E06B 3/7017* (2013.01); *E06B 3/725* (2013.01); *E06B 3/82* (2013.01); *E06B 3/822* (2013.01); *E06B 3/984* (2013.01); *E06B 2003/7046* (2013.01); *E06B 2003/7059* (2013.01); *E06B 2003/7082* (2013.01); *E06B 2003/7096* (2013.01)

(58) Field of Classification Search

CPC .. E06B 3/723; E06B 3/725; E06B 2003/7059; E06B 3/822; E06B 3/82; E06B 3/7017; E06B 3/984; E06B 2003/7082; E06B 2003/7046; E06B 2003/7096

USPC ..... 52/783.1, 783.12, 784.1, 784.13, 784.14, 52/784.15, 784.16, 793.1, 794.1, 800.1

See application file for complete search history.

(56) References Cited

U.S. PATENT DOCUMENTS

| | | | | |
|---|---|---|---|---|
| 2,765,056 A * | 10/1956 | Tyree | E06B 3/822 | 49/399 |
| 2,824,630 A * | 2/1958 | Tolman | E06B 3/822 | 428/116 |
| 3,271,919 A * | 9/1966 | Olton | E06B 3/88 | 52/800.13 |
| 4,152,876 A * | 5/1979 | Seely | E06B 3/825 | 49/503 |
| 5,218,807 A | 6/1993 | Fulford | | |
| 5,653,075 A * | 8/1997 | Williamson | E04C 2/246 | 52/309.9 |

(Continued)

FOREIGN PATENT DOCUMENTS

| | | |
|---|---|---|
| BE | 470678 A | 2/1947 |
| CN | 204476174 U | 7/2015 |

(Continued)

OTHER PUBLICATIONS

Combined Search and Examination Report dated Apr. 23, 2018 in corresponding United Kingdom Patent Application No. GB1800460.6.

(Continued)

*Primary Examiner* — Theodore V Adamos
(74) *Attorney, Agent, or Firm* — Ostrolenk Faber LLP

(57) ABSTRACT

A door panel comprising a body having front and rear door skins sandwiching, at least partially, two stiles, which together delimit an interior for injection of filling material. At least one of the stiles comprises a hollow structure with a partitioned hollow interior that extends along substantially the entire length of the body to offer mechanical strength to the door and to provide foundation for installing door fittings.

6 Claims, 5 Drawing Sheets

(56) References Cited

U.S. PATENT DOCUMENTS

| | | | | |
|---|---|---|---|---|
| 5,720,142 | A * | 2/1998 | Morrison | E04C 2/292 52/309.14 |
| 5,775,041 | A * | 7/1998 | Tull | E06L 33/10 403/231 |
| 5,800,651 | A | 9/1998 | Williamson | |
| 6,068,802 | A | 5/2000 | Berghorn et al. | |
| 6,453,638 | B2 * | 9/2002 | Chen | E06L 33/7015 52/717.01 |
| 6,668,499 | B2 * | 12/2003 | Degelsegger | B32B 17/10311 49/501 |
| 8,381,490 | B2 * | 2/2013 | Back | E04D 13/03 52/200 |
| 8,997,436 | B2 * | 4/2015 | Spear | E04F 13/0894 52/239 |
| 2001/0017019 | A1 * | 8/2001 | Degelsegger | A46D 1/00 52/783.1 |
| 2001/0045080 | A1 | 11/2001 | Chen | |
| 2002/0092258 | A1 * | 7/2002 | Rochman | E05L 317/2084 52/630 |
| 2002/0121071 | A1 * | 9/2002 | Heung-Bin | E06B 7/23 52/800.11 |
| 2005/0252126 | A1 | 11/2005 | Chan | |
| 2010/0269450 | A1 * | 10/2010 | Thielmann | E06L 33/72 52/784.15 |
| 2010/0281805 | A1 | 11/2010 | Garrett et al. | |
| 2016/0340964 | A1 * | 11/2016 | Wang | E06B 3/7015 |
| 2017/0268288 | A1 | 9/2017 | Sadeli | |

FOREIGN PATENT DOCUMENTS

| | | | |
|---|---|---|---|
| DE | 296 17 861 | U1 | 1/1997 |
| GB | 2 258 685 | A | 2/1993 |
| GB | 2492815 | A | 1/2013 |
| JP | S60-004577 | A | 1/1985 |
| TW | 201115008 | A | 5/2011 |

OTHER PUBLICATIONS

Examination Report dated Apr. 10, 2018 in corresponding Australian Patent Application No. 2018200275.

European Examination Report, dated Mar. 4, 2019, issued in corresponding European Patent Application No. 18 151 267.4. Total 6 pages.

* cited by examiner

DOOR PANEL AND A STILE THEREOF

The present invention relates to a customizable door panel and a stile thereof for example particularly, but not exclusively, a door panel with stile that is customizable in shape and size.

BACKGROUND OF THE INVENTION

Wooden doors are beautiful and sturdy but it falters in comparison to metal or plastic door in its necessity for upkeep. Overtime, wood is prone to warping and rotting. The expenses for maintenance add to the overall costs in having a wooden door.

Owing to the many benefits with uPVC doors, they have become the preferred option for houses and commercial buildings. They are proven to be good solution for affordable and durable doors. However one of the major drawbacks of uPVC doors is the issue of strength and security. They are not as durable and robust as wooden doors. Also, the shape and size is pre-determined at manufacture and alteration is not intended.

The invention seeks to eliminate or at least to mitigate such shortcomings for more strength and security without a substantial increase in costs by providing a new or otherwise improved customizable door panel and stile.

SUMMARY OF THE INVENTION

According to the invention, in a first aspect of the invention there is provided a door panel comprising a body having front and rear door skins sandwiching, at least partially, two stiles, which together delimit an interior for injection of filling material, wherein at least one of the stiles comprises a hollow structure with a partitioned hollow interior that extends along substantially the entire length of the body to offer mechanical strength to the door and to provide foundation for installing door fittings; optionally, the hollow structure is partitioned by elongated ribs that extends the entire length of the stile; optionally, the hollow structure is adjoined by a varnished portion which extends lengthwise along the entire length of the body and widthwise beyond the front and rear door skin; optionally, the front and rear skins engage outer surfaces of the stile through respective engagement means; optionally, the engagement means comprise male members extending from the front and rear skins respectively for engaging female members provided on the outer surface of the stile; optionally, the female member is in the form of a slanted groove defined between two slanted walls, one of the slanted walls presses against the male member to form a fluid tight engagement; optionally, a portion of the stile is trimmed away for adjusting the overall width of the door panel and remainder of the stile is lined by a further stile; optionally, the further stile is fixed to the remainder by way of adhesive; optionally, the further stile includes a body with an underside from which a stem portion extends; optionally, the stem portion is sandwiched between two slanted underside portions; optionally, the slanted underside portions taper towards the stem portion such that it forms a gap with the remainder for accommodating adhesive applied thereon; optionally, the varnished portion is integrally formed with the partitioned hollow interior as one piece; optionally, the varnished portion includes an internal void to reduce overall thickness of the varnished portion; optionally, further the door panel further comprises a rail with a first set of protrusions for insertion into respective partitioned hollow interiors; optionally, the rail includes a second set of protrusion for insertion into the interior and fitting between two stiles;

In a second aspect of the invention, there is provided a stile comprising a hollow structure with a partitioned hollow interior and a varnished portion provided alongside the hollow structure, wherein the partitioned hollow interior and the varnished portion are integrally formed as one piece; optionally, the hollow structure and the varnished portion are formed simultaneously by way of extrusion; optionally, the partitioned hollow interior includes two or more ribs extending along length of the interior defining parallel channels.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
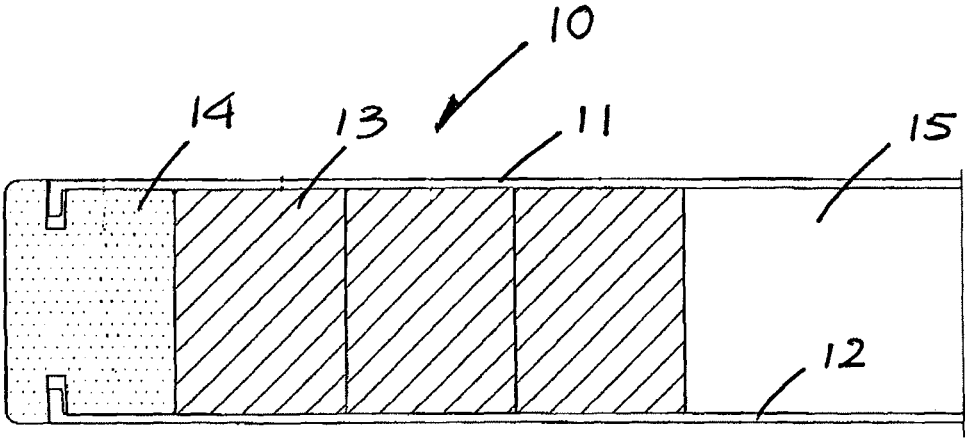
FIG. 1 is a cross-sectional view taken along length of a conventional door panel.
Figure 2:
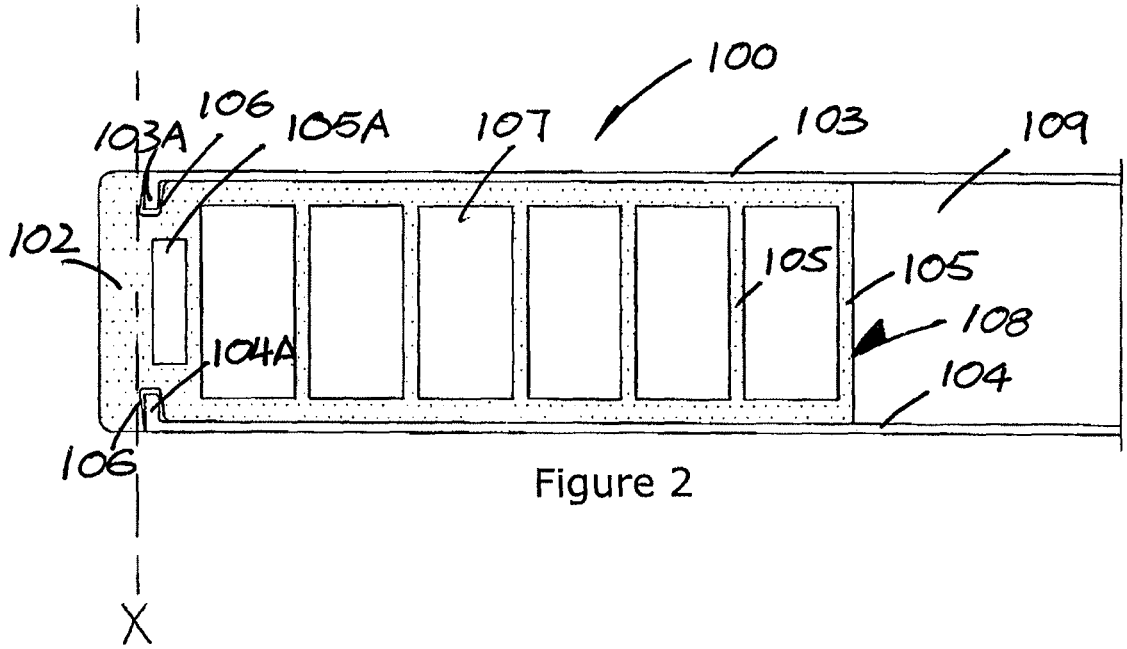
FIG. 2 is a cross-sectional view taken along length of a door panel in accordance with the invention.

Referring to FIG. 1, there is shown a door panel 10 with door skins 11 and 12, rails and stiles 14 delimiting an interior 15. The interior 15 includes a hollow portion 15. The hollow portion is to be injected with filling material such as PU foam. Adjacent the left and right stiles 14, wooden blocks are laid to provide foundation for installing door fittings.

FIGS. 2 to 6 show two embodiments of the door panel 100 and stile 101 in accordance with the invention. The body of the door panel is formed by front and rear skins 103 and 104 sandwiching a pair of stiles 101. Top and bottom rails 400 are provided to close off open ends of the door panel 100. They together define a hollow interior 109 to be filled with filing material such as PU foam. The stiles 101 and the rails 400 enhance the rigidity and improve the mechanical strength of the door panel 100.

In an embodiment of the invention, two stiles 101 are laid between the first and rear skin 103 and 104 and each stile 101 has a canaliculated portion 108. The canaliculated portion 108 is a hollow structure with a partitioned hollow interior 107 that extends along substantially the entire length of the door panel 100 to offer mechanical strength to the door. The overall stile 101 also provides foundation for installing door fittings. The door fittings include handle, lock and hinges. Each of the stiles 101 further includes a varnished outer end portion 102 which gives the door panel 100 an attractive external appearance. The varnished portion 102 is intended to extend beyond the skins 103 and 104 and to be exposed. The canaliculated portion 108 and the varnished portion 102 are formed simultaneously by extrusion and pultrusion in a single step. As such they are integrally formed as one piece.

The hollow structure 108 is partitioned by a plurality of elongated ribs 105 that runs along whole length of the interior. The ribs 105 define a plurality of elongated spaces in the form of channels 107 that run parallel to one another along the entire length of the interior. These ribs provide foundation for installing door fittings such as handle, lock and hinges.

Relative positions between the stiles 101 and the skins 103 and 104 are fixed by way of engagement means 106/103A/104A. The engagement means 106/103A/104A include male and female engagement members 106/103A/104A. The male engagement member is in the form of a hook 103A/104A extending from one end of the respective skin 103 and 104. The female engagement member is in the form of grooves 106 provided on respective front and rear sides of the stile 101.

Figure 3:
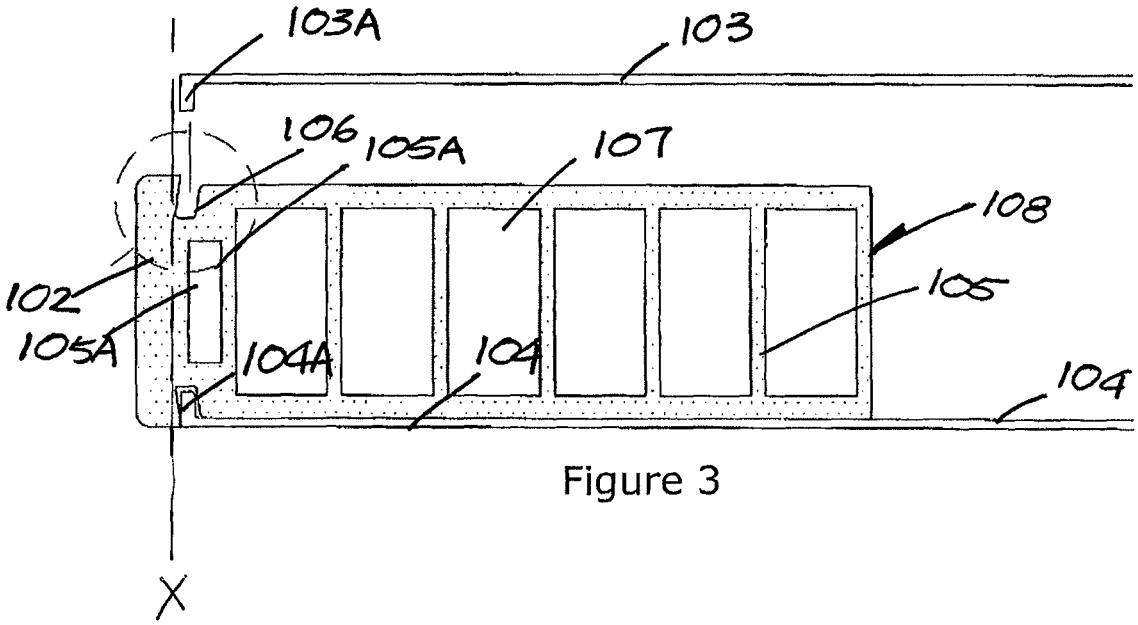
FIG. 3 is the cross-sectional view in FIG. 2 showing attachment of a door skin to stiles in accordance with the invention.

Referring to FIG. 3, the groove 106 is slanted. More specifically the parallel side walls of the groove 106 are slanted at an angle of about 5°-10° with respect to an imaginary vertical line X, such that top portion of the side wall 106A further away from the interior 109 of the door panel 100 presses against an upper corner of the hook 103A or 104A in a fluid tight manner to produce a perfect finishing and prevent liquid from entering or exiting there through. Gap is created between the walls of the groove 106 and rest of the hook 103A or 104A. Adhesive is retained in the gap and those in excess are forced into any space between the skin 103 or 104 and the stile 101. The tight fitting between the side wall 106A of the groove 106 and the corner of the hook 103A or 104A prevents any excess adhesive from leaving the groove 106 there through. This contributes to the overall clean and smooth finishing of the door panel 101.

Figure 4A:
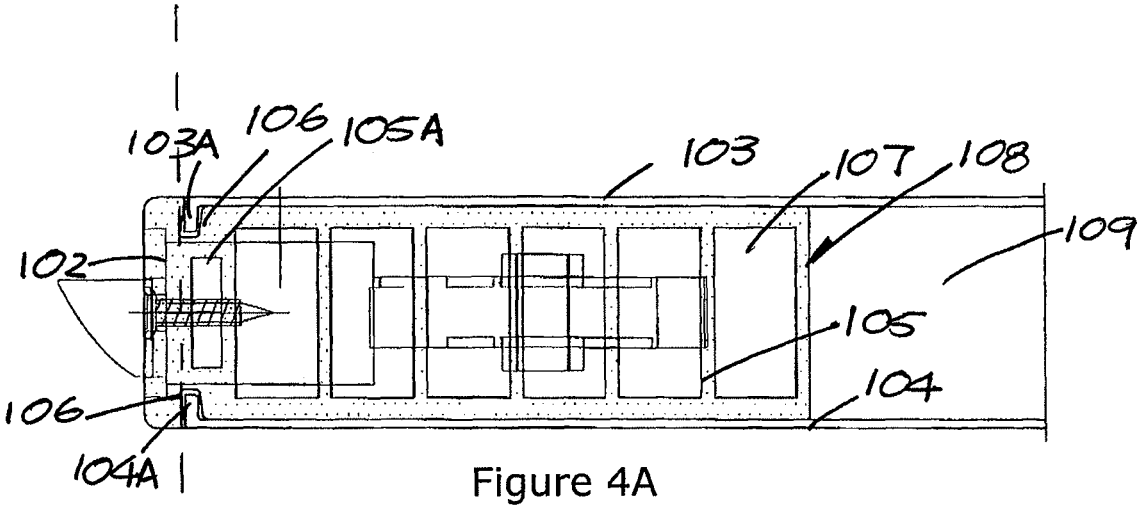
FIG. 4A and FIG. 4B show the cross-sectional view of the door panel in FIG. 2 with door lock and door hinge assembled.
Figure 4B:
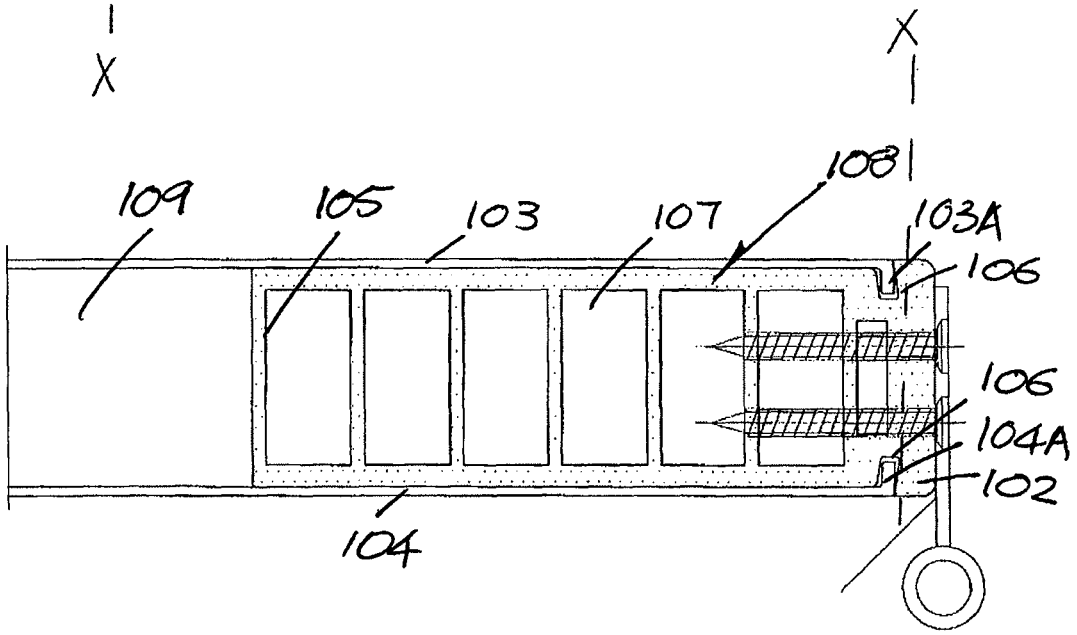

The stile 101 replaces the wooden block in conventional doors 19 for providing a support for assembling of handle, door lock and hinges as illustrated in FIGS. 4A and 4B. By cutting through the ribs 105, an aperture is created for installing the mortise. The connection plate of a door hinge can be screwed directly onto the varnished portion 102 and adjacent ribs 105 for anchorage.

Figure 5:
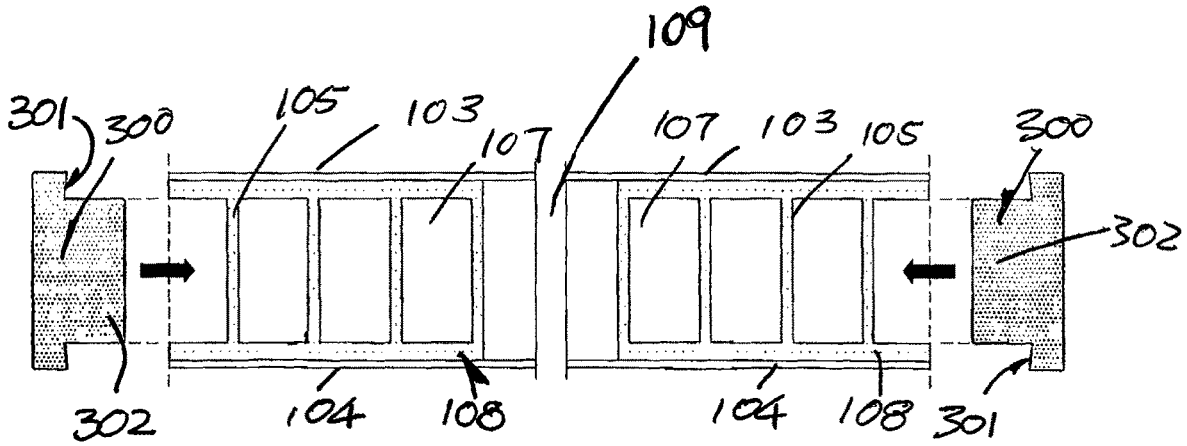
FIG. 5 is a cross-sectional view of the door panel in FIG. 2 with left and right sides being trimmed and left and right further stiles being inserted.

Referring to FIG. 5, there is shown a further embodiment of the invention. To adjust the overall width of the door panel 100, the stile 101 together with the skin 103 and 104 are trimmed resulting in a raw opened end. The opened end is closed by a further separate stile 300. The stile 300 is a T-shaped separate piece attachable to the trimmed stile 101 by way of adhesive. A stem 302 protrudes from an underside 301 of the stile 300. As shown in FIG. 5, the stile 300 is sandwiched by two undersides 301 that tapers towards the stem 302 forming an angle of about 40° with a side wall of the stem 302. An outer portion of each of the slanted underside presses onto the free end of the respective skins 103A and 104A to form a fluid tight engagement. A gap is formed between rest of the slanted surface and the stile 101 for accommodating excessive adhesive therein. The fluid tight engagement prevent adhesive from passing there-through to maintain the overall clean and smooth finishing of the door panel 100.

Noteworthy, a void 105A is formed in the varnished portion 102 of the stile 101 which is useful to mitigate any distortion resulting in uneven cooling of the stile 101. It also decreases the thickness of the varnished portion 102 without affecting the external appearance thereof to permit more even cooling of the member 101 after extrusion.

Figure 6:
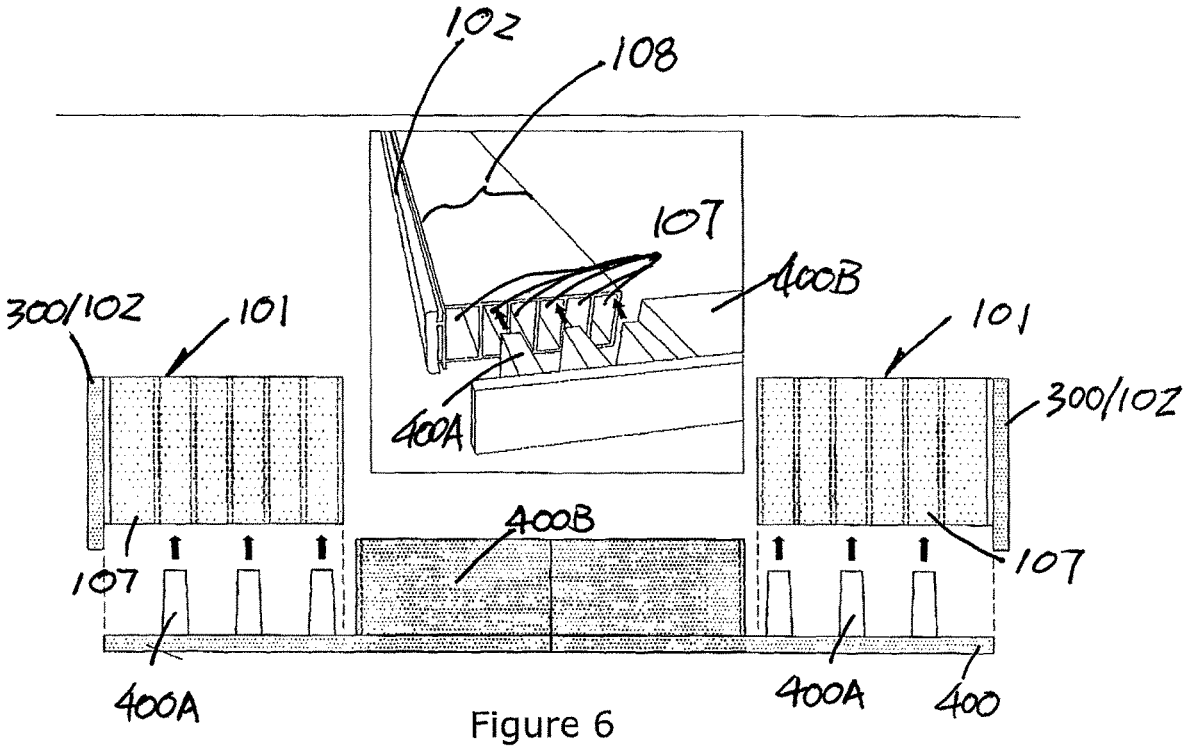
FIG. 6 is a illustrative drawing showing a rail being assembled to the door panel in FIG. 2.

Referring to FIG. 6, top rail and bottom rail 400 are assembled to the door panel 100 after the stile 101/300 and the skin are in place. The rail 400 includes two sets of protrusions 400A and 400B. A first set of protrusions 400A are provided adjacent the left and right end portions of the rail 400 dimensioned for insertion into the channels 107 defined by the ribs 105 in the stile 101. A second set of protrusion 400B is preferably a single piece structure extending into the interior 109 defined by the left and right stiles 101 and the front and rear skins 103 and 104. The rail 400 is secured in position by way of adhesive applied on the protrusions 400A and/or 400B. Each of the protrusions 400A is conical in shape without a pointed end. It tapers towards its free end for easy insertion which is guided by the ribs 105 defining the channel 107. Once the stile 101/300, the skins 103 and 104 and the rails 400 are in place, filling material is injected to fill the interior 109. The cured foam secures the skins 103 and 104, the stile 101 as well as the rails 400 together.

The invention has been given by way of example only, and various other modifications of and/or alterations to the described embodiment may be made by persons skilled in the art without departing from the scope of the invention as specified in the appended claims.

The invention claimed is:

1. A door panel comprising:

a body comprising front and rear door skins sandwiching, at least partially, a first stile and a second stile separate from the first stile;

the first and second stiles together being configured to delimit an interior of the door panel configured to receive an injection of filing material, wherein at least one of the first and second stiles comprises a hollow structure with a partitioned hollow interior that extends along substantially an entire length of the body and providing mechanical strength to the body and providing a foundation for installing door fittings, wherein adjacent the hollow structure is a portion to be varnished integrally formed therewith as one piece, wherein the front and the rear door skins engage respective outer surfaces of the stiles through an engagement between cooperating sets of male and female members, wherein the male members are arrayed over and extend from the front and rear skins and each of the male members engages with a cooperating corresponding one of the female members, wherein each female member is provided on outer surfaces of the stile and at the portion to be varnished, and the female member is in the form of a groove defined between two walls of one of the stiles, the groove is configured such that upon insertion of one of the male members in the groove of a corresponding one of the female members, at least one of the two walls defining the groove presses against the male member in the groove to form a fluid tight engagement; and the at least one of the two walls extends along an axis inclined at an angle with respect to a direction of insertion of the male members such that a top portion of the at least one of the two side walls defining a respective female member closer to an outer side of the stile presses against a corresponding male member but a remaining portion of the at least one of the two side walls defining the respective female member is free of contact with the corresponding male member;

the portion to be varnished includes an internal void isolated from the hollow interior of the hollow structure so as to reduce overall thickness of the portion to be varnished.

2. The door panel as claimed in claim 1, further comprising elongated ribs positioned to partition the hollow structure, the elongated ribs extending the entire length of the stile.

3. The door panel as claimed in claim 1, wherein the portion to be varnished extends lengthwise along the entire length of the body and widthwise beyond the front and rear door skins.

4. The door panel as claimed in claim 1, further comprising a top rail and a bottom rail, each of the top and bottom rails comprising a first set of protrusions, each of the first set of protrusions being dimensioned for insertion into a channel defined by ribs in the respective first and second stiles.

5. The door panel as claimed in claim 4, wherein each of the top and bottom rails further includes a second set of protrusions for insertion into a hollow interior of the body and the second set of protrusions fitting between the first and the second stiles.

6. The door panel as claimed in claim 1, wherein the side walls of each female groove are slanted at an angle of approximately 5°-10° with respect to an imaginary vertical line x.

* * * * *